US010900509B2

(12) United States Patent
Loebig

(10) Patent No.: US 10,900,509 B2
(45) Date of Patent: Jan. 26, 2021

(54) SURFACE MODIFICATIONS FOR IMPROVED FILM COOLING

(71) Applicant: Rolls-Royce Corporation, Indianapolis, IN (US)

(72) Inventor: James Loebig, Greenwood, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 137 days.

(21) Appl. No.: 16/241,648

(22) Filed: Jan. 7, 2019

(65) Prior Publication Data

US 2020/0217337 A1 Jul. 9, 2020

(51) Int. Cl.

| | |
|---|---|
| ***F15C 1/02*** | (2006.01) |
| ***F15D 1/12*** | (2006.01) |
| ***F01D 5/18*** | (2006.01) |

(52) U.S. Cl.

CPC ..... *F15D 1/12* (2013.01); *F01D 5/186* (2013.01); *F05D 2250/181* (2013.01); *F05D 2250/60* (2013.01); *F05D 2260/202* (2013.01); *F05D 2260/22141* (2013.01)

(58) Field of Classification Search

CPC ..... F15D 1/12; F15D 1/003; F15D 1/0035; F15D 1/004; F15D 1/0045; F01D 5/186; F01D 9/065; F01D 25/12; F05D 2240/128; F05D 2260/202; F05D 2220/32; F05D 2260/22141; F05D 2250/60; F05D 2250/181

USPC .... 137/808, 809, 833, 842; 416/97 A, 236 R

See application file for complete search history.

(56) References Cited

U.S. PATENT DOCUMENTS

| | | | | |
|---|---|---|---|---|
| 3,423,069 | A | 1/1969 | Chandley | |
| 4,907,765 | A * | 3/1990 | Hirschel | B64C 21/10 244/130 |
| 5,133,516 | A * | 7/1992 | Marentic | B05D 5/02 244/130 |
| 5,337,568 | A | 8/1994 | Lee et al. | |
| 5,653,110 | A | 8/1997 | Lee et al. | |
| 5,975,850 | A * | 11/1999 | Abuaf | F01D 5/187 415/115 |
| 6,092,982 | A * | 7/2000 | Ikeda | F01D 5/186 137/806 |
| 6,145,319 | A * | 11/2000 | Burns | F23R 3/002 60/754 |
| 6,213,711 | B1 * | 4/2001 | Muller | F01D 5/145 415/191 |
| 7,695,241 | B2 * | 4/2010 | Lee | F15D 1/12 415/1 |
| 8,066,478 | B1 * | 11/2011 | Shih | F01D 5/186 416/1 |

(Continued)

FOREIGN PATENT DOCUMENTS

| | | | |
|---|---|---|---|
| JP | 2006523294 | A | 10/2006 |
| WO | 2004064990 | A2 | 8/2004 |

*Primary Examiner* — Minh Q Le

(74) *Attorney, Agent, or Firm* — Brinks Gilson & Lione

(57) ABSTRACT

A member may have a first major surface and a second major surface. The first major surface may define a plurality of riblets that may extend in the direction of a primary flow. The member may form an array of conduits that extend from an entrance port at the second major surface to an exit port at the first major surface. Each of the exit ports may intersect two or more riblets. Each of the exit ports may intersect a riblet that intersect another of the exit ports.

19 Claims, 15 Drawing Sheets

(56) References Cited

U.S. PATENT DOCUMENTS

| | | | | |
|---|---|---|---|---|
| 8,228,675 | B2 | 7/2012 | Koplow | |
| 9,109,452 | B2 * | 8/2015 | Martin | F01D 5/186 |
| 9,879,861 | B2 * | 1/2018 | Pinnick | F23R 3/002 |
| 2005/0003146 | A1 * | 1/2005 | Spath | B29C 45/375 428/105 |
| 2012/0247111 | A1 | 10/2012 | Narcus et al. | |
| 2013/0156595 | A1 * | 6/2013 | Sander | F01D 5/145 416/241 R |
| 2014/0255200 | A1 | 9/2014 | Guo et al. | |
| 2016/0010473 | A1 * | 1/2016 | Spangler | F01D 11/20 415/177 |
| 2016/0153281 | A1 * | 6/2016 | Barr | F23R 3/002 415/116 |
| 2016/0177829 | A1 * | 6/2016 | Loebig | F28F 3/048 415/1 |
| 2019/0168862 | A1 * | 6/2019 | Riera | F01D 5/145 |
| 2019/0277144 | A1 * | 9/2019 | LoRicco | F01D 11/08 |
| 2020/0217207 | A1 * | 7/2020 | Loebig | F01D 25/12 |

* cited by examiner

SURFACE MODIFICATIONS FOR IMPROVED FILM COOLING

BACKGROUND

Turbine engines are a form of combustion engine. Like most combustion engines, the high temperatures created within a turbine engine can have adverse effects on the material properties of the structure forming the engine. Examples of these structures include the combustor, turbine blades, and the engine exhaust region. To combat these high temperatures, various cooling methods are employed. The efficiency and effectiveness of methods and systems used to cool components subject to a hot working fluid need improvement.

SUMMARY

According to some aspects of the present disclosure, a member is provided. The member may have a first major surface and a second major surface. The first major surface may define a plurality of riblets that may extend in the direction of a primary flow. The member may form an array of conduits that extend from an entrance port at the second major surface to an exit port at the first major surface. Each of the exit ports may intersect two or more riblets. Each of the exit ports may intersect a riblet that intersect another of the exit ports.

According to some aspects of the present disclosure, a member is provided. The member may have a primary major surface that extends in the direction of a primary flow. The member may form an array of conduits. Each conduit may have an exit port at the primary major surface. The primary major surface may define a set of grooves that extend from each of the exit ports to a first downstream position from the exit port in the primary flow direction. The grooves may extend in a direction that has a lateral component relative to the primary flow direction.

According to some aspects of the present disclosure, a method of forming a thermal barrier is provided. The method may comprise providing a member, forming an array of conduits, and forming a plurality of riblets. The member may have a first major surface and a second major surface. The array of conduits may be formed in the member. Each of the conduits may extend from an entrance port at the second major surface to an exit port at the first major surface. The plurality of riblets may be formed on the first major surface. The riblets may extend in a primary flow direction. Adjacent riblets may define a groove having curved walls.

BRIEF DESCRIPTION OF THE DRAWINGS

The following will be apparent from elements of the figures, which are provided for illustrative purposes.

Figure 1A:
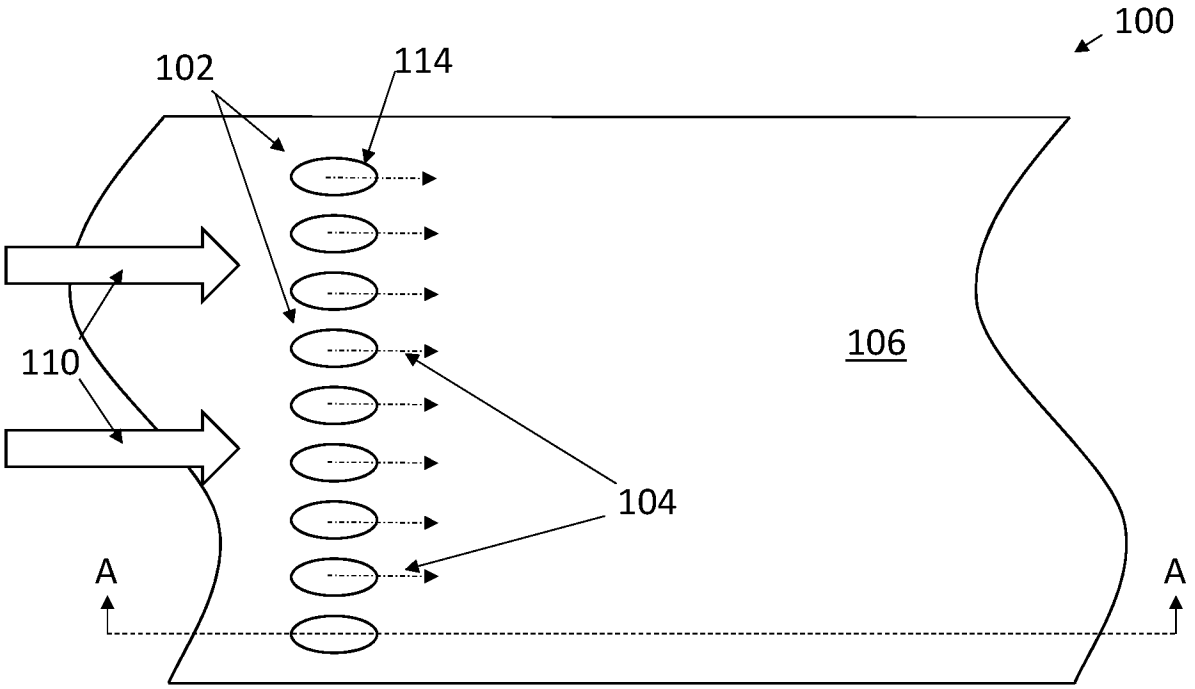
FIG. 1A illustrates a plan view of an array of cooling holes.

The present application discloses illustrative (i.e., example) embodiments. The claimed inventions are not limited to the illustrative embodiments. Therefore, many implementations of the claims will be different than the illustrative embodiments. Various modifications can be made to the claimed inventions without departing from the spirit and scope of the disclosure. The claims are intended to cover implementations with such modifications.

DETAILED DESCRIPTION

For the purposes of promoting an understanding of the principles of the disclosure, reference will now be made to a number of illustrative embodiments in the drawings and specific language will be used to describe the same.

Figure 1B:
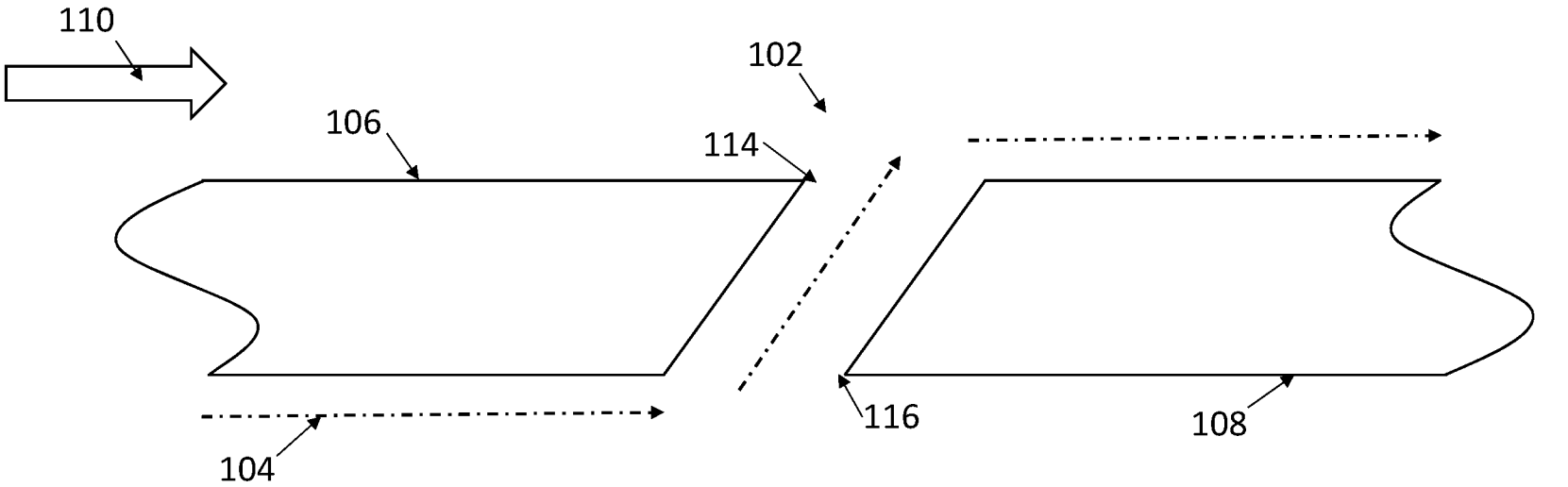
FIG. 1B illustrates a cross-section of the array of a cooling hole of FIG. 1A taken through 'A-A'.

FIG. 1A and FIG. 1B are illustrations of a member 100 having a plurality of conduits 102 that provide a cooling fluid 104. FIG. 1A is a plan view of member 100, and FIG. 1B is a cross-section view of member 100 taken through 'A-A'. Member 100 has a pair of major surfaces—primary major surface 106 and secondary major surface 108. As used herein, "primary" refers to the hot or working fluid and "secondary" refers to the cooler or non-working fluid. Therefore, primary major surface 106 is the surface exposed to the hot, working fluid 110, and secondary major surface 108 is exposed to the cooling fluid 104. Member 100 may be made from metal, ceramics, composites, or other suitable material. Member 100 may be located in or downstream of a combustor, near or on the turbine airfoils and flow path components, in or downstream of the turbine exhaust, or on or near another component requiring cooling.

Primary major surface 106 and secondary major surface 108 may be parallel to and/or opposed one another, or may not be parallel to one another. In some embodiments, the two surfaces 106 and 108 may form a curved member 100 such that a distance between the surfaces 106 and 108, measured in a direction normal from one of the surfaces to the other surface, is constant. In other embodiments, the distance between the major surfaces may not be constant.

Member 100 forms an array of conduits 102 that extend between primary major surface 106 and secondary major surface 108. Each of the conduits 102 may be a cylindrical hole drilled through member 100. Elliptical openings (ports) are formed on primary major surface 106 and secondary major surface 108 when the conduit 102 is formed because the axis of conduit 102 is at a non-zero angle relative to normal of primary major surface 106 and secondary major surface 108. If conduit 102 were drilled normal to primary major surface 106 and secondary major surface 108, a circular opening would be formed in both surfaces 106 and 108. Member 100 may be a solid member, meaning that it is formed of a continuous material between both surfaces 106 and 108 with the exception of conduit 102. Exit port 114 is located on the primary major surface 106; entrance port 116 is located on the secondary major surface 108.

A cooling fluid 104 is supplied to member 100 on its secondary major surface 108 side at a sufficient pressure to drive the cooling fluid 104 through conduits 102. Ideally, the cooling fluid 104 forms a film on primary major surface 106. This film provides both a barrier between the hot working fluid 110 and primary major surface 106 and a heat sink for member 100. This is known as film, or effusion, cooling. However, the cooling fluid 104 exiting the array of conduits 102 can encounter counter-rotating vortices when the cooling fluid film interacts with the large, primary fluid flow 110. In turn, these vortices can lift a significant portion of the cooling fluid 104 away from the primary major surface 106, causing a loss of the heat sink and thermal barrier. As a result of this loss of the effusion cooling, the primary major surface 106 will reach higher temperature, potentially shortening component lifespan of or requiring member 100 to be comprised of different materials.

One solution to address this problem is to provide more cooling fluid 104 to the conduits 102 to account for the removal of cooling fluid film. Supplying more cooling fluid 104 reduces system efficiency as, for example, more bleed air is removed from the compressor and, therefore, also from the working fluid.

Another solution to addressing the loss of the cooling film layer has been to use differently shaped conduits. For example, shaped holes have been explored as a potential solution to the undesirable loss of the cooling film by creating vortices that tend to cancel those created by the cooling film—primary fluid interaction. Shaped conduits utilize a single, conduit extending through the member 100, but have a complex exit region intended to affect the flow characteristics of cooling fluid 104. However, the complex exit region may require micromachining which is expensive compared to other drilling technologies, e.g., water jets, lasers, and electrical discharge machining (EDM).

There exists a need for methods and systems having improved effusion cooling capabilities and higher system efficiencies that can be made at lower cost.

Figure 2A:
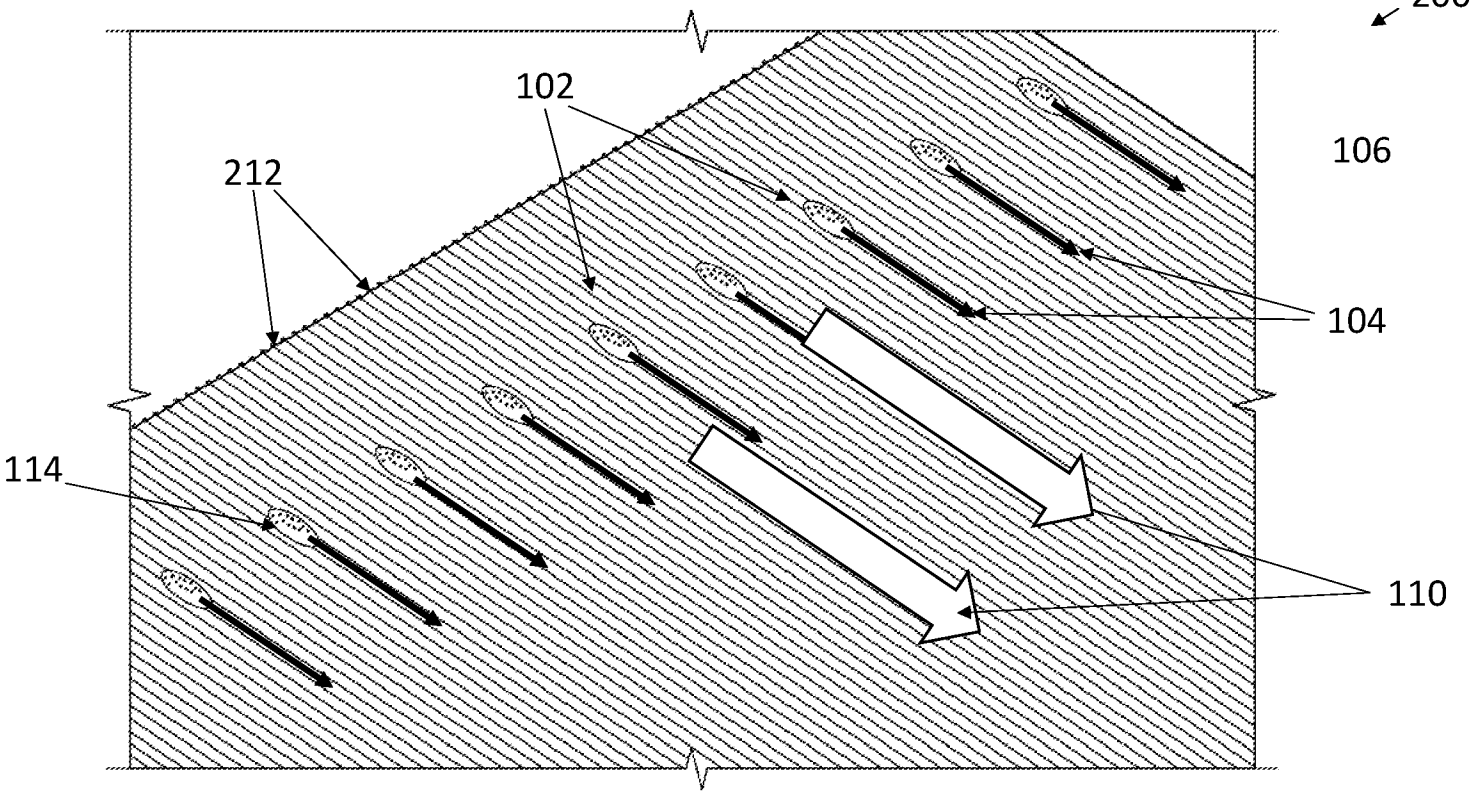
FIG. 2A is a perspective view of a member having an array of conduits and riblets in accordance with some embodiments.
Figure 2B:
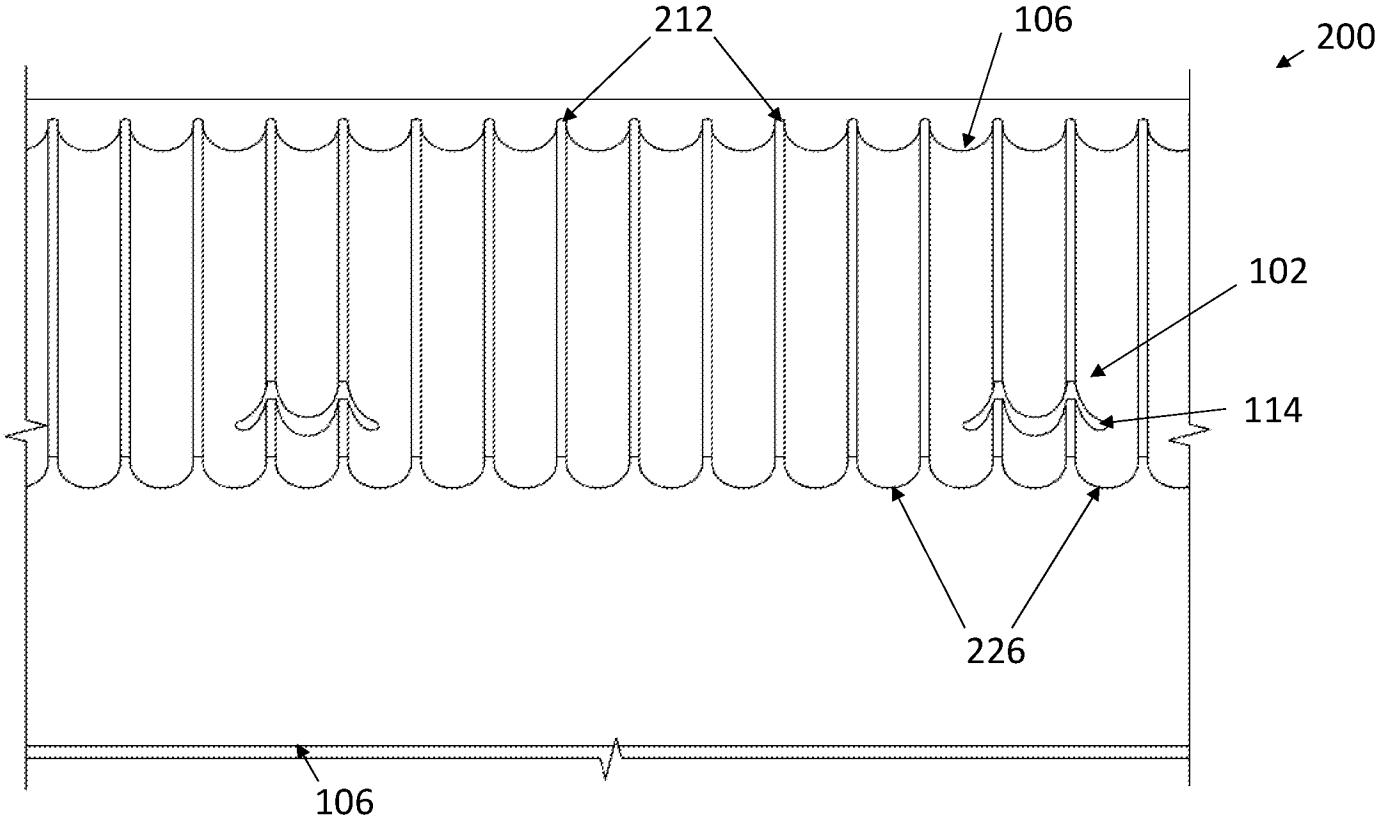
FIG. 2B is a different perspective view of the member of FIG. 2A in accordance with some embodiments.

In accordance with some embodiments, a member 200 having an array of conduits 102 is provided for in FIGS. 2A and 2B. FIG. 2A is a perspective view of a member 200 having an array of conduits 102; FIG. 2B is a different perspective view of the member 200 of FIG. 2A. Member 200 may comprise the same materials and perform similar functions as member 100 described above. Member 200 may have a primary major surface 106 and a secondary major surface 108. The primary major surface 106 may define a plurality of riblets 212. These riblets 212 may be aligned in the direction of the primary flow 110. In accordance with some embodiments, the riblets 212 may fan in fan out, such that they converge or diverge from one another. Member 200 may define a plurality of conduits 102 that extend from an entrance port (not shown) on the secondary major surface 108 to an exit port 114 on the primary major surface 108. Each of the exit ports 114 may intersect two or more of the riblets 212.

Figure 3A:
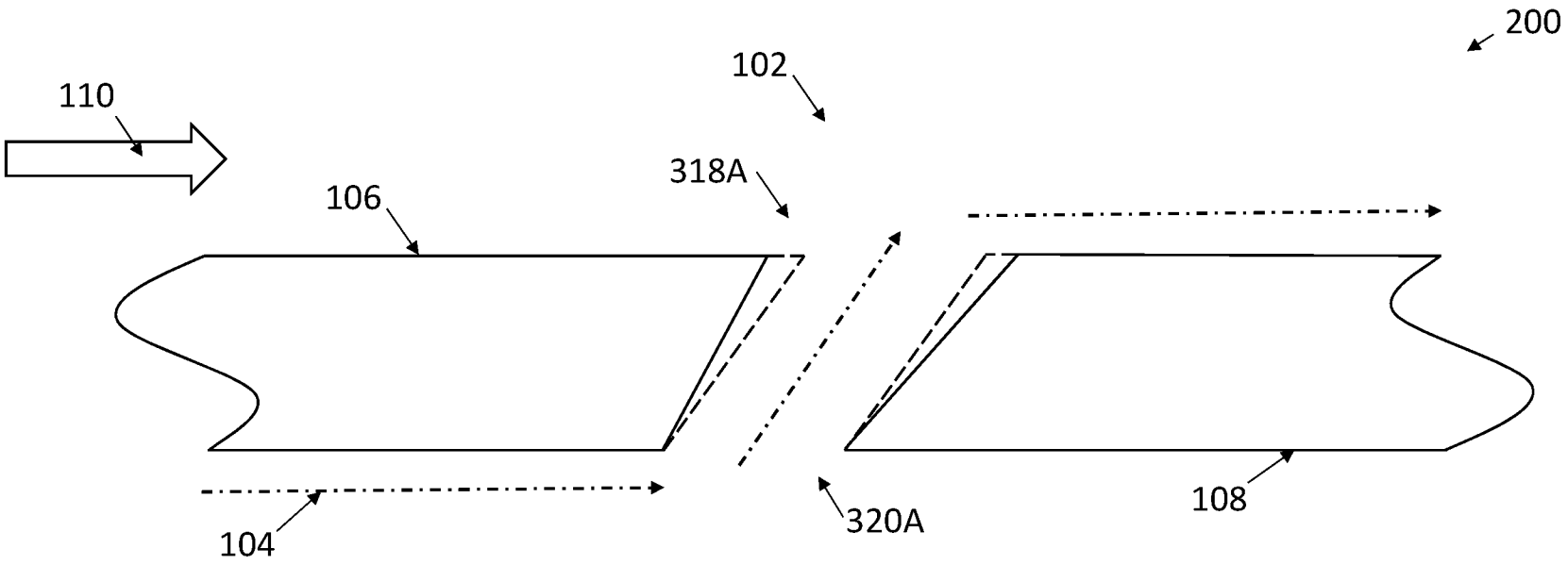
FIGS. 3A and 3B illustrate cross-sectional views of a conduit of the member of FIG. 2A in accordance with some embodiments.
Figure 3B:
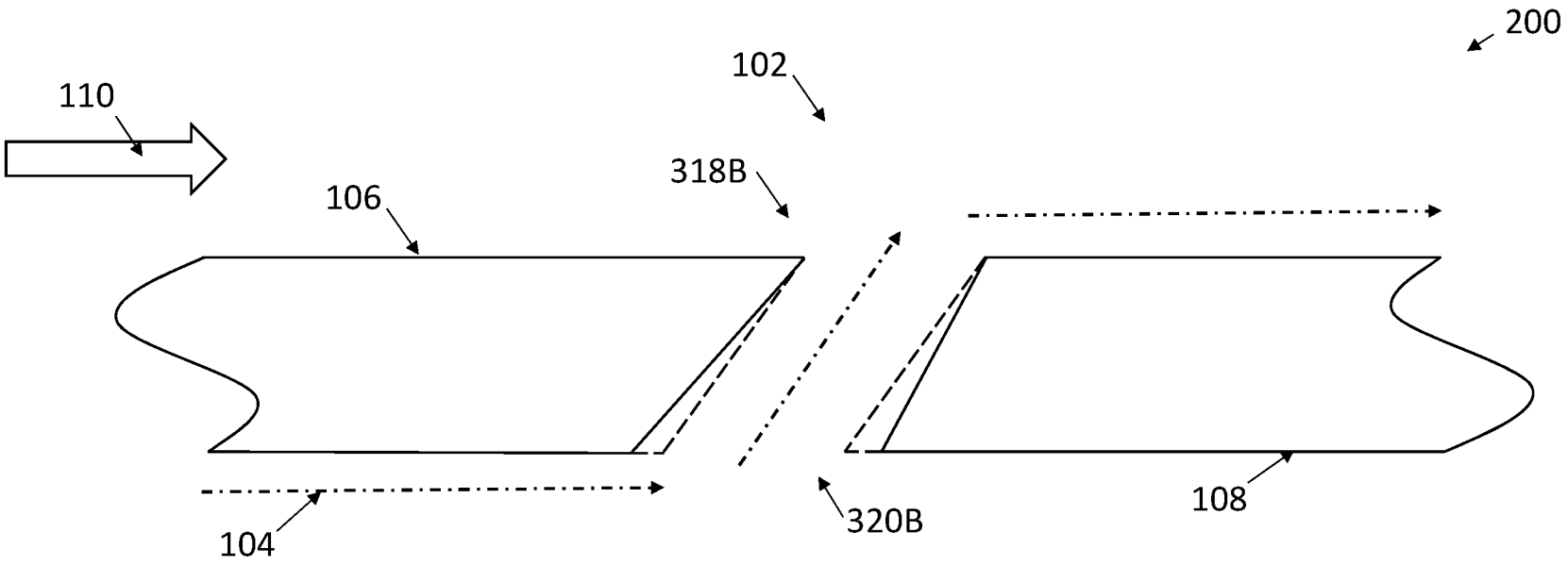

Each conduit 102 may have a circular cross section about its respective axis when it is drilled in member 200. In some embodiments, this circular cross section is constant along the axial length of conduit 102. In such cases, the conduits 102 are cylindrical. In accordance with some embodiments, the conduits may be conical. These conduits may be drilled by, e.g., a laser that tends to produce a conical shape as more material is removed from the side on which the laser first engages the member. Examples of such embodiments are illustrated in FIGS. 3A and 3B—both cross sectional views of a conduit of member 200. With reference to FIG. 3A, an embodiment in which the conduit 102 is drilled from the primary major surface 106 is presented. As can be seen, conduit 102 has an opening 318A in the primary major surface 106 that is larger than the opening 320A in the secondary major surface 108. In this embodiment, the cross section of the conduit decreases in area from the primary major surface 106 to the secondary major surface 108. The dotted lines between the lateral sides of conduit 102 represent the outer diameter of a cylindrical conduit having a cross section area equal to the area of the opening 320A. As can be seen in FIG. 3A, the walls of conduit 102 diverge from this cylindrical hole. It should be understood that this divergence is large in FIG. 3A for ease of reference, and that the actual divergence between the conical conduit 102 and the cylindrical conduit may be different from that shown.

Turning to FIG. 3B, an example of a conduit 102 drilled from the secondary major surface 108 is presented. Conduit 102 may have an opening 320B in the secondary major surface 108 that is wider than its opening 318B in the primary major surface 106. Like FIG. 3A, the dotted lines in FIG. 3B represent the outer diameter of cylindrical conduit. In this embodiment, the cross section of the conduit 102 increases in area from the primary major surface 106 to the secondary major surface 108. The selection of a conical conduit 102 like that in FIG. 3A or FIG. 3B is influenced by the overall system design of the turbine engine. The conical conduit 102 of FIG. 3A provides for better film cooling, while the conical conduit 102 of FIG. 3B may provide for fewer overall losses.

Each conduit 102 can be defined by the angle of its axis relative to normal of the primary major surface 106 (also known as a streamwise angle), known herein as angle 'A,' as well as the angle of its axis relative to the overall direction of the primary fluid flow (also known as a spanwise angle), herein known as angle 'B.' A person having ordinary skill will recognize that the direction of the primary fluid flow is complex. As used herein, the primary fluid flow direction refers to the direction of the velocity vector of the near hot-wall flow.

Figure 4A:
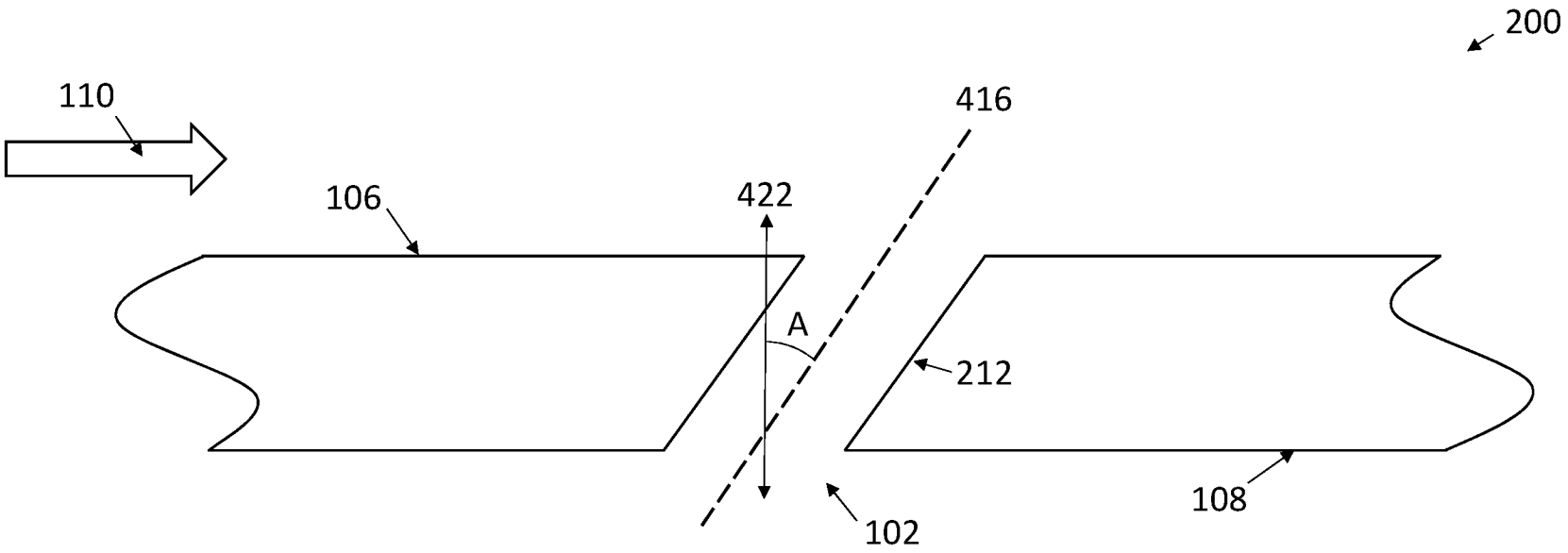
FIGS. 4A and 4B illustrate a cross-sectional view and a plan view, respectively, of a conduit of the member of FIG. 2A in accordance with some embodiments.

FIG. 4A illustrates a cross sectional view of one of the conduits 102 of member 200 in accordance with some embodiments. This figure illustrates angle 'A' and the direction 422 that this normal to the primary major surface 106. It should be understood that FIG. 4A illustrates the cross section along the axis of one of conduits 102. In accordance with some embodiments, angle 'A' is between 15 and 45 degrees. In accordance with some embodiments, angle 'A' is approximately 20 degrees. As can be appreciated, angle 'A' can be an acute angle.

Figure 4B:
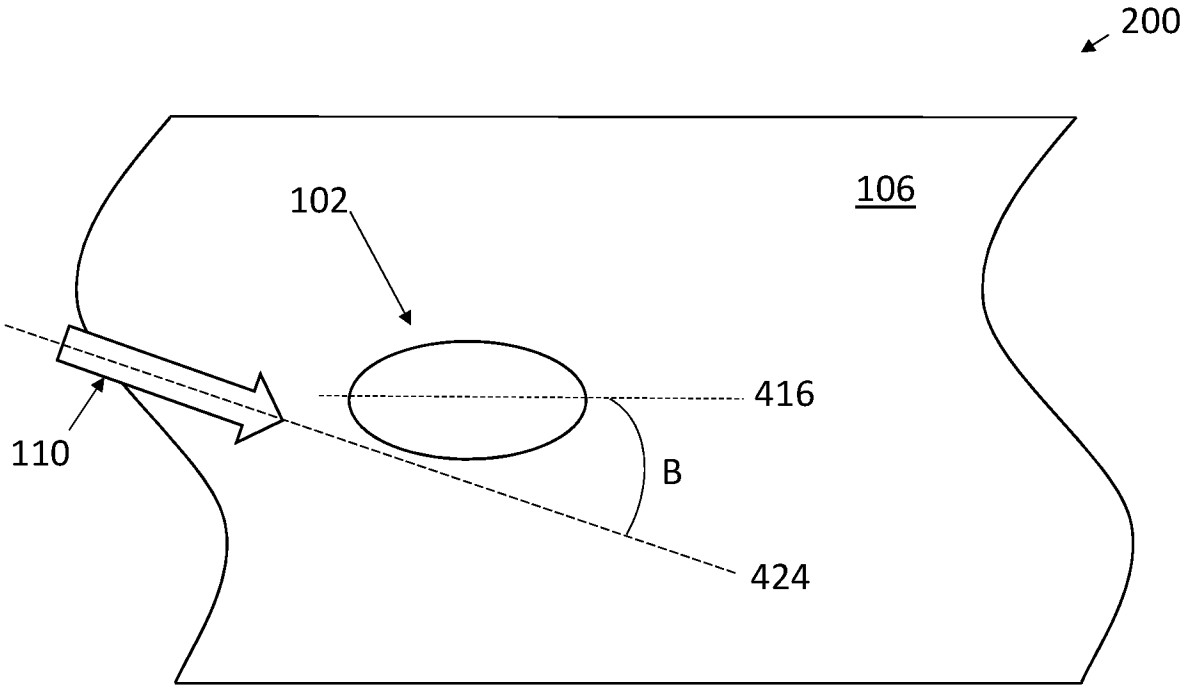

FIG. 4B illustrates a plan view of the member 200 in accordance with some embodiments. As can be seen, axis 416 of conduit 102 forms an angle 'B' with the direction of the primary fluid 424. In accordance with some embodiments, angle 'B' is between 0 and 45 degrees. In accordance with some embodiments, angle 'B' is between 5 and 15 degrees. In accordance with some embodiments angle 'B' is zero degrees.

With reference back to FIG. 2B, riblets 212 may define a groove 226 between adjacent riblets 212. This groove may have curved walls. These curved walls of groove 226 may be formed by electrochemical and/or chemical etching of the primary major surface 106 to form the riblets 212. This method of forming riblets 212 is preferred for members 200 comprising metal. For members 200 having thermal barrier coatings (TBC) or environmental barrier coated (EBC) ceramic matrix composites (CMC) materials, riblets may be preferably formed using laser glazing. Laser glazing can form grooves 226 having curved walls (such as those shown in FIG. 2B). Additionally, laser glazing may densify the TBC and/or EBC surface. The thickness and height of any un-etched plateau of the riblets, and the width and depth of the grooves 226 can be varied in order to maximize cooling film persistence for a particular application.

Figure 5:
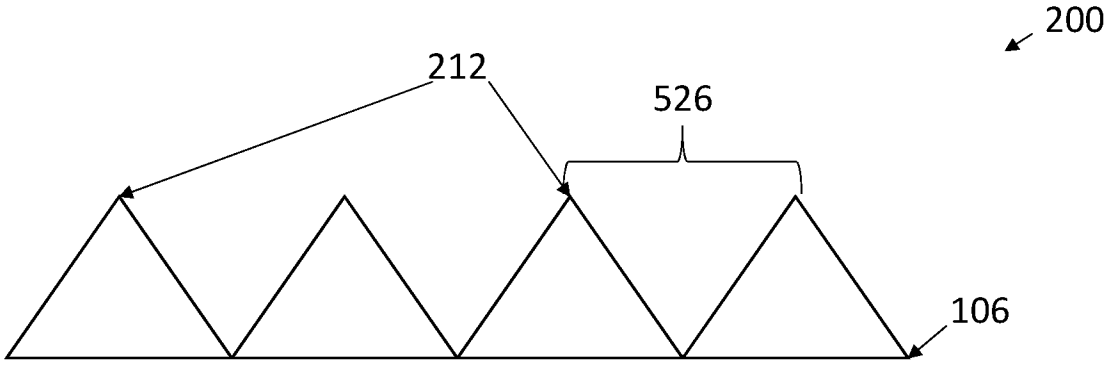
FIG. 5 illustrates an elevation view of a member 200 in accordance with some embodiments.

In accordance with some embodiments, the grooves may comprise shapes other than curves. For example, FIG. 5 illustrates an elevation view of a member 200 in accordance with some embodiments. As can be seen, grooves 526 may have planar walls that may extend from the peaks of the riblets 212 to down the primary major surface 106. This planar shape of groove may be made by, e.g., micromachining of primary major surface 106. While groove 526 is shown with clean, pointed peaks and valleys, the micromachining process may round these parts of groove 526. However, a significant planar portion to the groove walls will remain.

Computational fluid dynamics (CFD) analysis demonstrated that riblets 212 are effective in reducing the amount of cooling fluid 104 film removed by vortices created from the interaction with the primary working fluid 110. However, riblets may also dampen the spread of the cooling film across the width (perpendicular to the primary working fluid 110 flow direction) of member 200. To account for the possibility of this reduced spread, rows of conduits 102 may be formed such that some conduits 102 overlap.

Figure 6:
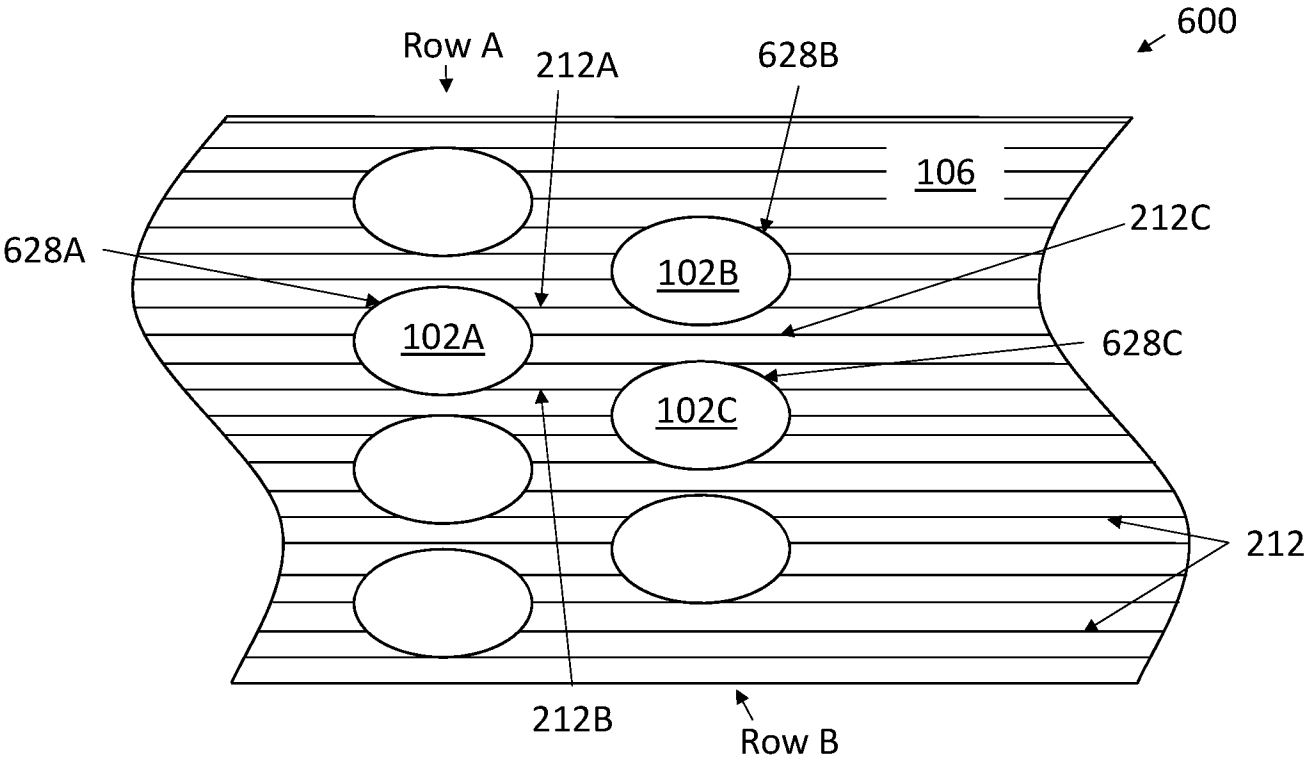
FIG. 6 is a plan view of a member having overlapping conduits in accordance with some embodiments.

An example of a member 600 having overlapping conduits in accordance with some embodiments is illustrated in FIG. 6. FIG. 6 is a plan view of member 600. Conduits 102 may be formed into rows, such as conduit 102A in Row A and conduits 102B and 102C in Row B. The lateral spacing (along the width of member 600, i.e., from the top to bottom of FIG. 6) between the center of the conduits 102 is less than the minor diameter of the conduit opening such that the edges of the conduits 102 overlap with each other. For example, upper edge of 628A is located closer to the upper portion of FIG. 6 than is lower edge of 628B, such that conduit 102A overlaps with conduit 102B. On the other side, conduit 102A overlaps with conduit 102C (the lower edge of 628A is located closer to the bottom portion of FIG. 6 than is the upper edge of 628C). Riblets 212 may be formed on primary major surface 106 such that one or more riblets intersect the exit port of another conduit. For example, riblet 212A intersects the exit port of both conduit 102A and 102B, and riblet 212B intersects the exit port of both conduit 102A and 102C. Some riblets, such as riblet 212C may intersect only one conduit 102 exit port. In some embodiments, this riblet (like riblet 212C) may pass between conduits 102B and 102C.

CFD analysis of ribbed vs. ribless members having overlapping conduits was performed to validate the improved cooling capabilities of ribbed surfaces. The results from this analysis is provided for in FIGS. 7A to 7C. Each simulation had common parameters and member structures except for the exclusion (FIG. 7A) or inclusion (FIG. 7B) of ribs. Each member comprised 4 rows of 20 degree conduits. The temperature of the primary working fluid is 3000 degrees Fahrenheit, the temperature of the cooling fluid is 800 degrees Fahrenheit for each simulation. Both models used a blowing parameter (equal to the ratio of the density of the coolant times the velocity of the coolant to the density of the working fluid times the velocity of the working fluid) of about 2. Periodic boundary conditions were used for models of the same lateral width.

Figure 7A:
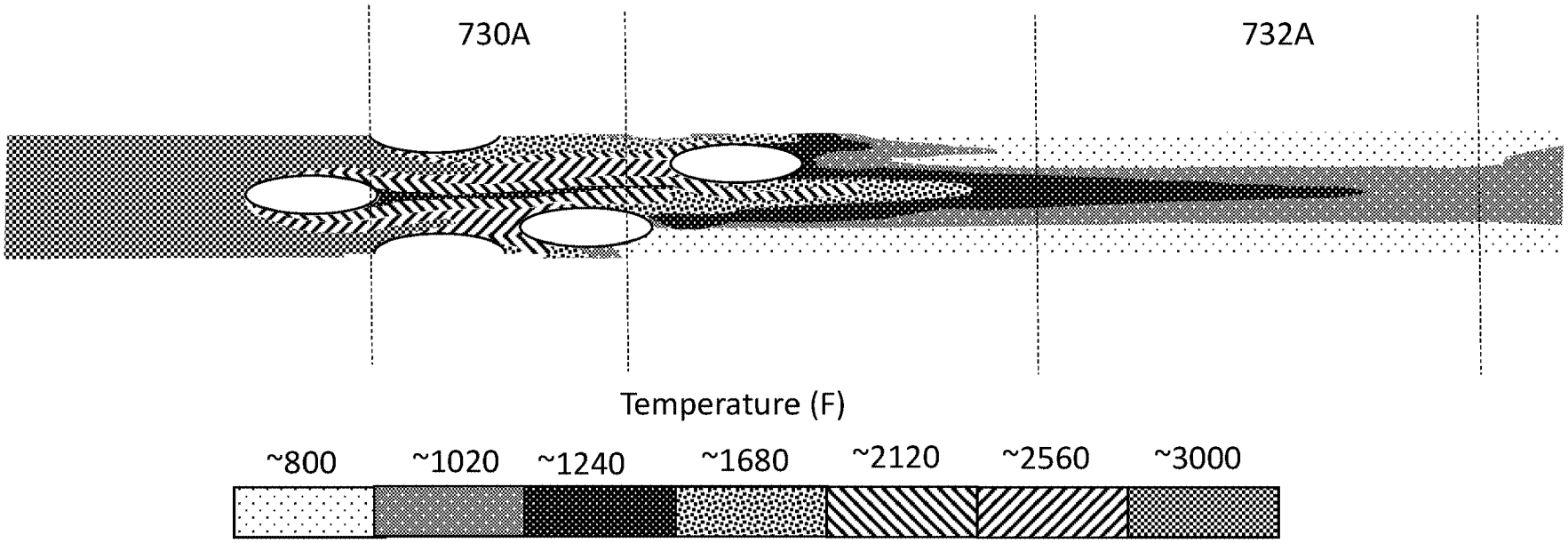
FIG. 7A illustrates the analytical temperature of a ribless wall.
Figure 7B:
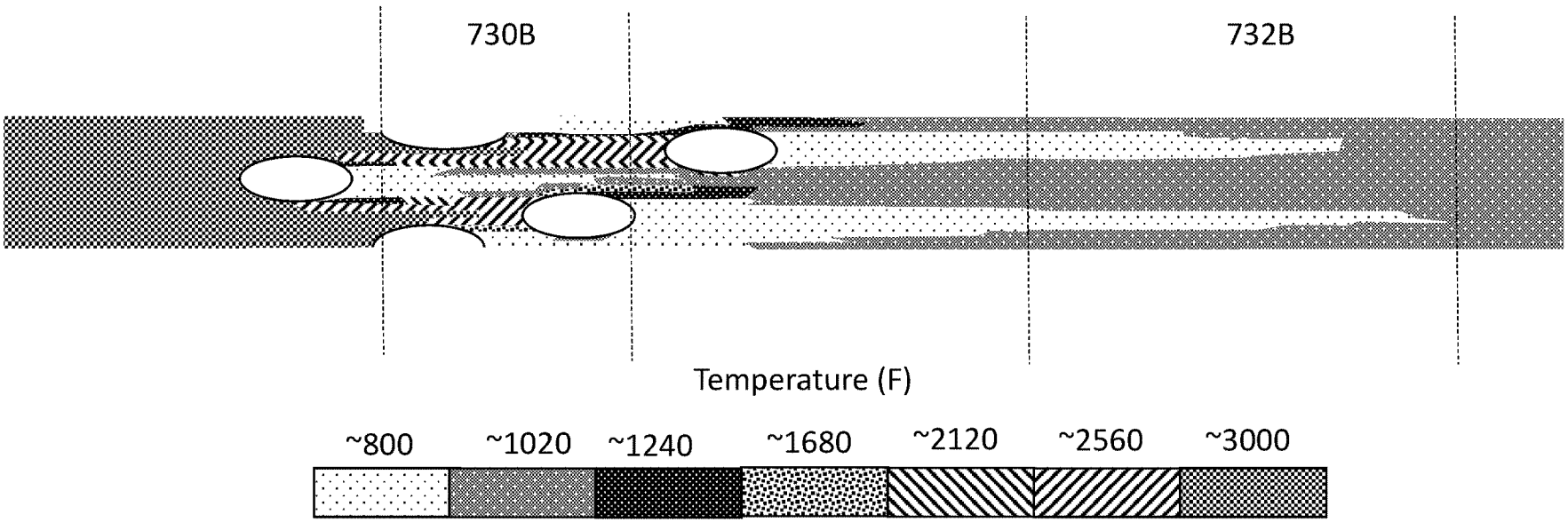
FIG. 7B illustrates the analytical temperature of a ribbed wall in accordance with some embodiments.

As can be seen in the comparison between FIGS. 7A (ribless) and 7B (ribbed), the temperature of the member has more lateral variation in the ribless than ribbed model, particularly when comparing regions 730A and 730B. Additionally, the overall temperature of the ribbed model is lower than the ribless model, particularly in region 732B compared to 732A. The average temperature of the ribless wall was 1635 degrees Fahrenheit. The average temperature of the ribbed wall was 1585 degrees Fahrenheit, an improvement of 50 degrees Fahrenheit over the ribless configuration. This result indicates that less of the cooling fluid film on the ribbed wall is removed by vortices when compared to a ribless wall.

Figure 7C:
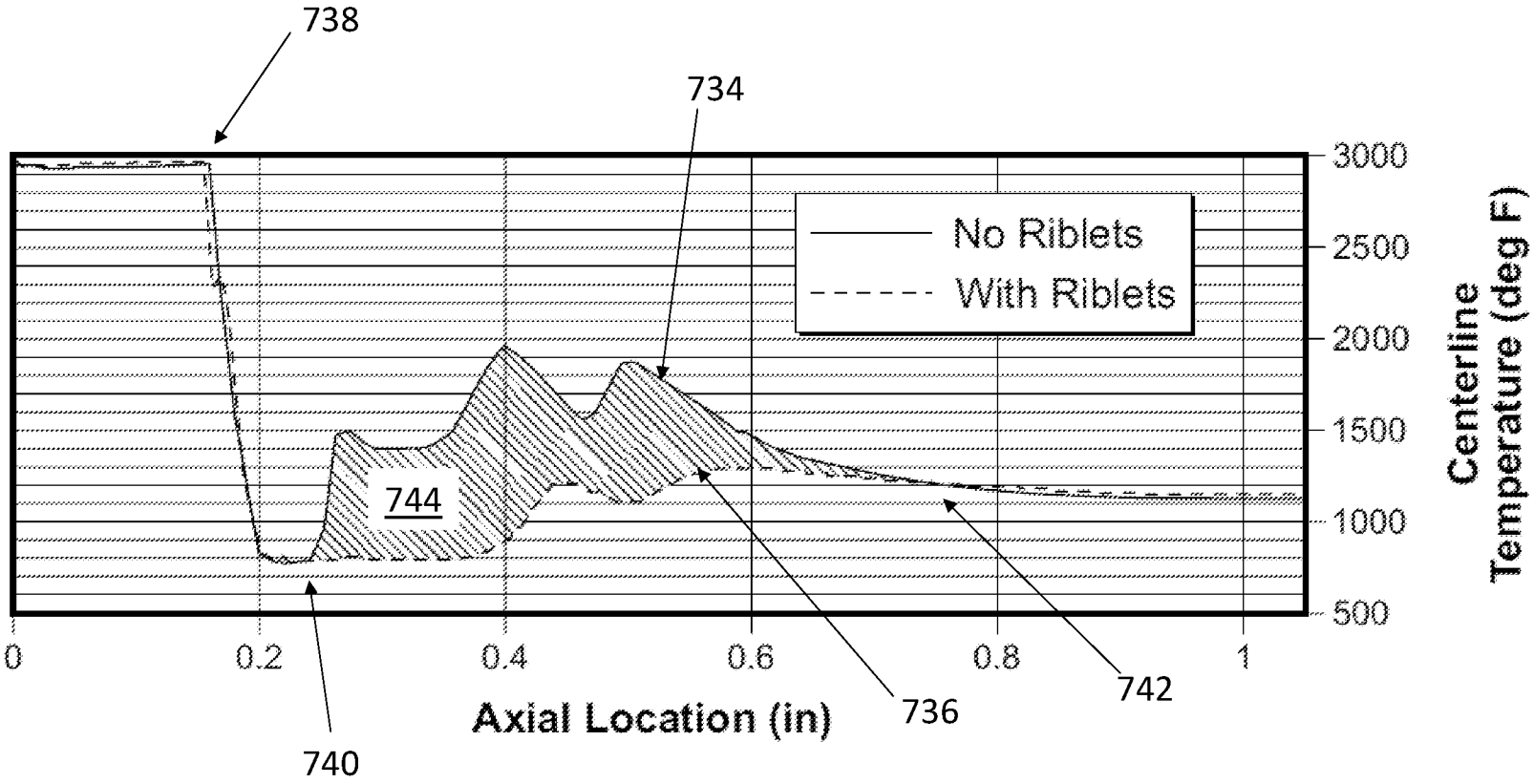
FIG. 7C is a graph of the analytical centerline temperature of a ribbed and ribless wall in accordance with some embodiments.

FIG. 7C illustrates the centerline temperature of a ribbed wall in accordance with some embodiments compared to a ribless wall. Line 736 represents the centerline temperature of the ribbed wall. Line 734 represents the centerline temperature of a ribless wall. The temperature of the wall first beings dropping at the beginning of the conduits around point 738. As can be seen, the effect of the vortices do not begin until approximately point 740, which is downstream of one or more cooling conduits. At this point, Line 734 begins to rise whereas Line 736 remains steady. The divergence between the lines continues until point 742. The lines re-converge as the cooling fluid and hot working fluid mix in the various embodiments. The total increase in heat retained in the ribless wall compared to the ribbed wall is proportional to the area 744 the between lines 734 and 736 from point 740 to point 742.

Figure 8:
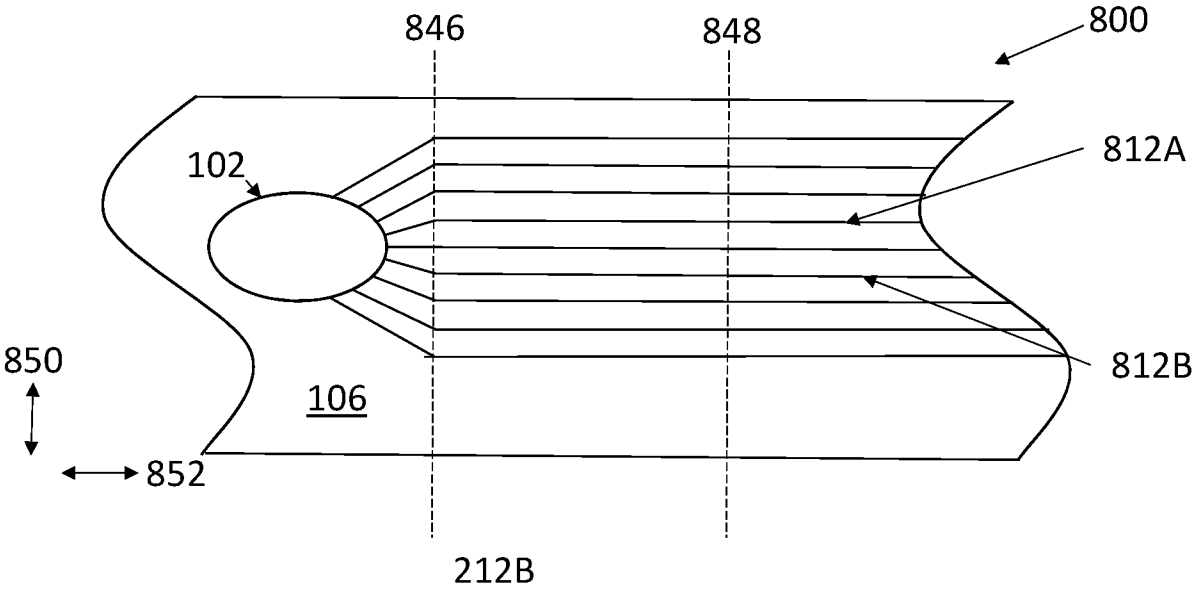
FIG. 8 is a plan view a member having riblets in accordance with some embodiments.

In accordance with some embodiments, a plan view of a member 800 having riblets 812 is provided in FIG. 8. Member 800 may be similar to the above described members. Member 800 comprises conduits 102 (only one of which is shown in FIG. 8) having entrance and exit ports as described above. Primary major surface 106 of member 800 has riblets 812, that may comprise the same material and have the same features as riblets 212 described above. However, riblets 812 may have a portion that extends in a direction (850) that is lateral to the primary flow direction (852). As can be seen, riblets 812 extend from the exit port of conduit 102 to a first downstream position 846. Between the exit port and the downstream position 846, the riblets 812 extend in both the lateral 850 and downstream 852 directions. Some of these riblets, such as riblet 812A, may have a lateral extension that is in the opposite direction of the lateral extension of other riblets, such as riblet 812B. From the first downstream position 846, riblets 812 extend in the primary flow direction (852) to downstream position 848. Between the downstream positions 846 and 848, the riblets 812 may run substantially parallel to one another. Each riblet 812 may intersect only one exit port of a conduit 102. Grooves may be formed between riblets 812 as described above.

Figure 9:
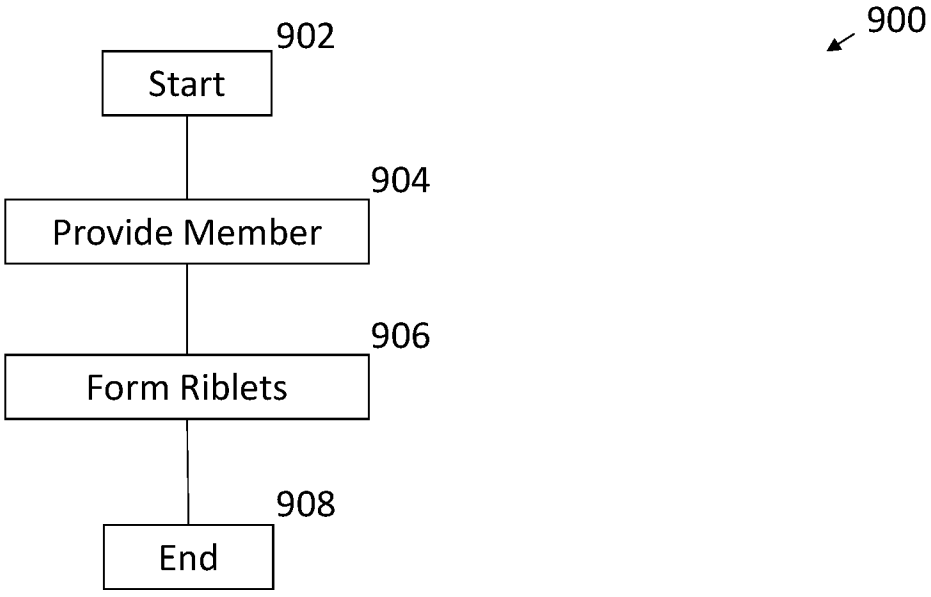
FIG. 9 is a block diagram of a method of forming a ribbed member in accordance with some embodiments.

A method of forming a ribbed member (which may be referred to as a thermal barrier) in accordance with some embodiments is provided for in FIG. 9. The formed member, riblets, conduits, and other components may have the features, characteristics, and components as described above. The method starts at block 902. At block 904, a member is provided. The member may have conduits extending between major surfaces as described above. At block 906, riblets are formed on one of the major surfaces of the member. The riblets may have the features and characteristics as described above. At block 908 the method ends.

Although examples are illustrated and described herein, embodiments are nevertheless not limited to the details shown, since various modifications and structural changes may be made therein by those of ordinary skill within the scope and range of equivalents of the claims.

What is claimed is:

1. A member having a first major surface and a second major surface, said first major surface defining a plurality of riblets extending in a primary flow direction, said member forming an array of conduits each extending from an entrance port at said second major surface to an exit port at said first major surface, each of said exit ports intersecting two or more riblets of said plurality of riblets, and each of said exit ports intersecting at least one riblet of said plurality of riblets that intersects another of said exit ports.

2. The member of claim 1 comprising a first exit port intersecting a first riblet of said plurality of riblets intersecting a second exit port and a second riblet of said plurality of riblets intersecting a third exit port.

3. The member of claim 2 wherein said first exit port further intersects a third riblet of said plurality riblets intersecting no other exit port.

4. The member of claim 1 further comprising a riblet of said plurality of riblets intersecting only one exit port.

5. The member of claim 1 wherein adjacent riblets define a groove having curved walls.

6. The member of claim 1 wherein adjacent riblets define a groove having planar walls.

7. The member of claim 1 wherein an angle measured between an axis of a conduit of said array and a direction normal to said first major surface is between 15 degrees and 45 degrees.

8. The member of claim 7 wherein an angle measured between an axis of a conduit of said array and a direction normal to said first major surface is 20 degrees.

9. The member of claim 1 wherein an angle measured between an axis of a conduit of said array and said primary flow direction between 0 degrees and 45 degrees.

10. A member having a primary major surface extending in a primary flow direction, said member forming an array of conduits each having an exit port at said primary major surface, said primary major surface defining a set of grooves extending from each of said exit ports to a first downstream position from said exit port in the primary flow direction, said set of grooves comprising grooves that extend in a direction having a lateral component relative to the primary flow direction.

11. The member of claim 10 wherein said set of grooves comprises grooves extending in directions having opposing lateral components relative to the primary flow direction.

12. The member of claim 11 wherein each of said grooves in said set of grooves extends from the first downstream position in the primary flow direction to a second downstream position.

13. The member of claim 12 wherein said set of grooves are substantially parallel between the first and second downstream positions.

14. The member of claim 10 wherein each of said grooves in said set of grooves extends from the first downstream position in the primary flow direction to a second downstream position.

15. The member of claim 14 wherein said set of grooves are substantially parallel between the first and second downstream positions.

16. The member of claim 10, wherein each of said grooves intersects a single exit port.

17. The member of claim 10 wherein said grooves have curved walls.

18. A method of forming a thermal barrier, comprising:

forming an array of conduits in a member having a first major surface and a second major surface, each of said conduits extending from an entrance port at said second major surface to an exit port at said first major surface; and forming an plurality of riblets on said first major surface, said plurality of riblets extending in a primary flow direction, wherein adjacent riblets of said plurality of riblets define a groove having curved walls, wherein said riblets extend from each of said exit ports to a first downstream position from said exit port in the primary flow direction, said riblets comprising grooves that extend in a direction having a lateral component relative to the primary flow direction.

19. The method of claim 18, wherein each of said exit ports intersects two or more riblets of a said plurality of riblets, and each of said exit ports intersects at least one riblet of said plurality of riblets that intersects another of said exit ports.

* * * * *